United States Patent [19]

Wallerstein

[11] Patent Number: 4,542,554

[45] Date of Patent: Sep. 24, 1985

[54] LOW COST, RENEWABLE SCRAPING IMPLEMENT

[76] Inventor: Martin A. Wallerstein, P.O. Box 6077, Ft. Myers Beach, Fla. 33931

[21] Appl. No.: 610,589

[22] Filed: May 15, 1984

[51] Int. Cl.[4] ..... A47L 13/08

[52] U.S. Cl. ..... 15/236 R; 30/169

[58] Field of Search ..... 15/143 R, 146, 176, 15/236 R, 245, 256.5, 256.51; 30/169

[56] References Cited

U.S. PATENT DOCUMENTS

| | | | |
|---|---|---|---|
| 3,122,767 | 3/1964 | Carvill | 15/236 R |
| 4,017,970 | 4/1977 | Williams | 30/169 |
| 4,200,948 | 5/1980 | Nesseth | 15/236 R |
| 4,202,093 | 5/1980 | Wallerstein | 15/236 R |
| 4,430,769 | 2/1984 | Bergström | 15/236 R |
| 4,447,293 | 5/1984 | Watanabe | 15/236 C |

FOREIGN PATENT DOCUMENTS

| | | | |
|---|---|---|---|
| 599715 | 6/1960 | Canada | 15/236 R |

*Primary Examiner*—Philip R. Coe
*Assistant Examiner*—Arthur D. Dahlberg
*Attorney, Agent, or Firm*—Kramer and Brufsky

[57] ABSTRACT

A low cost scraping implement has a plastic, elongated handle component with a recess in one surface thereof. A square of plate glass is held in the recess between a pair of downwardly extending safety, side surfaces in the handle by a retaining plate provided with a complementary recess. A bolt is received in aligned countersunk openings drilled through the handle member and the retaining plate and a nut threaded onto the shank of the bolt draws the retaining plate towards the handle member to clamp the glass square in place. The glass square can be repositioned within the recess to present eight different scraping edges. A worn or broken glass plate can be readily replaced to renew the scraper.

7 Claims, 4 Drawing Figures

LOW COST, RENEWABLE SCRAPING IMPLEMENT

BACKGROUND OF THE INVENTION

1. Field of the Invention

The present invention relates to scraping implements and more particularly, to an improved, low cost, renewable scraping implement.

2. Description of the Prior Art

Scraping devices are used for a number of different purposes. Such devices may be used to remove loose paint prior to re-painting an object or unwanted paint after painting, e.g., around a window pane. A related use is in removing varnish or other protective coatings from furniture which is being refinished. But perhaps the most common and well known use for scraping implements is in removing accumulated ice or snow from the windows of motor vehicles. In colder climates, a sturdy ice scraper is considered an indispensable item by almost all motorists.

Many different types of scrapers have been developed for these and other purposes. Scrapers intended for use in removing paint or varnish have largely been made of metal because of the stresses placed on such scrapers and because of the requirement that the scraping edge remain sharp for a relatively long time.

Scrapers intended for use in removing ice and snow from windows of motor vehicles have largely been made of plastic materials. Low cost scrapers have for the most part been one piece molded items. More expensive scraper elements have been made from harder plastic materials such as Plexiglass. The plastic material might be used for the entire scraper or be used in the form of a permanent insert.

One problem with known low cost scrapers is that the scraping material tends to wear quickly or to shatter under load. Thus, the entire scraping implement has to be frequently replaced.

While more expensive scrapers tend to last longer, their obvious drawback is that they cost more initially.

Moreover, because particular scrapers have been developed for particular purposes, they are often unsuited for other purposes due to the choice of materials and the scraper configuration.

Accordingly, in my prior U.S. Pat. No. 4,202,093, issued May 13, 1980, a truly multi-purpose scraping implement having the low cost of molded plastic scrapers, the durability of more expensive scrapers and the added advantage that it can be employed for different purposes without changing the scraping element, was first disclosed and suggested. The scraping implement was renewable in that a worn or broken scraping element can either be repositioned or readily replaced with another identical low cost element.

In a preferred embodiment of the disclosed invention, the scraping implement included a handle member having a recess in one surface. The recess extends to at least one edge of the handle member. A retaining member is adapted to be seated against the surface of the handle member including the recess. A polygonal scraping blade element having four to eight alternatively usable scraping edges is received in the recess with at least one edge of the scraping element exposed. Releasable securing means are provided for drawing the retaining member toward the handle member to clamp the scraping element in place.

This invention relates to an improved construction of the scraping implement disclosed in U.S. Pat. No. 4,202,093, retaining the most desirable features of that implement, but rendering the implement easier to manipulate and safer to use.

SUMMARY OF THE INVENTION

In accordance with the invention, the handle member is provided with an elongated extension disposed at an obtuse angle to the scraping element, enabling easier leveraged motion to be imparted to the scraping element along with positioning of the scraping element in hard to reach, normally inaccessible locations, while reducing the fatigue factor present in holding the handle. The elongated handle also provides a convenient means for storing the implement by the provision of a mount-receiving opening therethrough.

The handle member is designed to enwrap and cover a portion of the sharp side edges of the scraping element to preclude accidental contact with the hand while using the implement and to provide structural rigidity precluding shattering of the implement when pressed to a surface being scraped.

The retaining plate can be provided with a blade element-receiving recess in combination with a raised lip along the from edge of the retaining plate to enable the scraping element to be ever so slightly canted along its rear edge relative to the handle and retaining plate so that it is securely locked in place and prevented from wobbling, in clamped relation between the handle and plate.

All securing means are recessed within the handle and retaining plate so there is no accidental contact of the exterior of the implement with the surface undergoing treatment.

BRIEF DESCRIPTION OF THE DRAWINGS

While the specification concludes with claims particularly pointing out and distinctly claiming that which is regarded at the present invention, further details of a preferred embodiment of the invention may be more readily ascertained from the following detailed description when read in conjunction with the accompanying drawings wherein:

DETAILED DESCRIPTION

Figure 1:
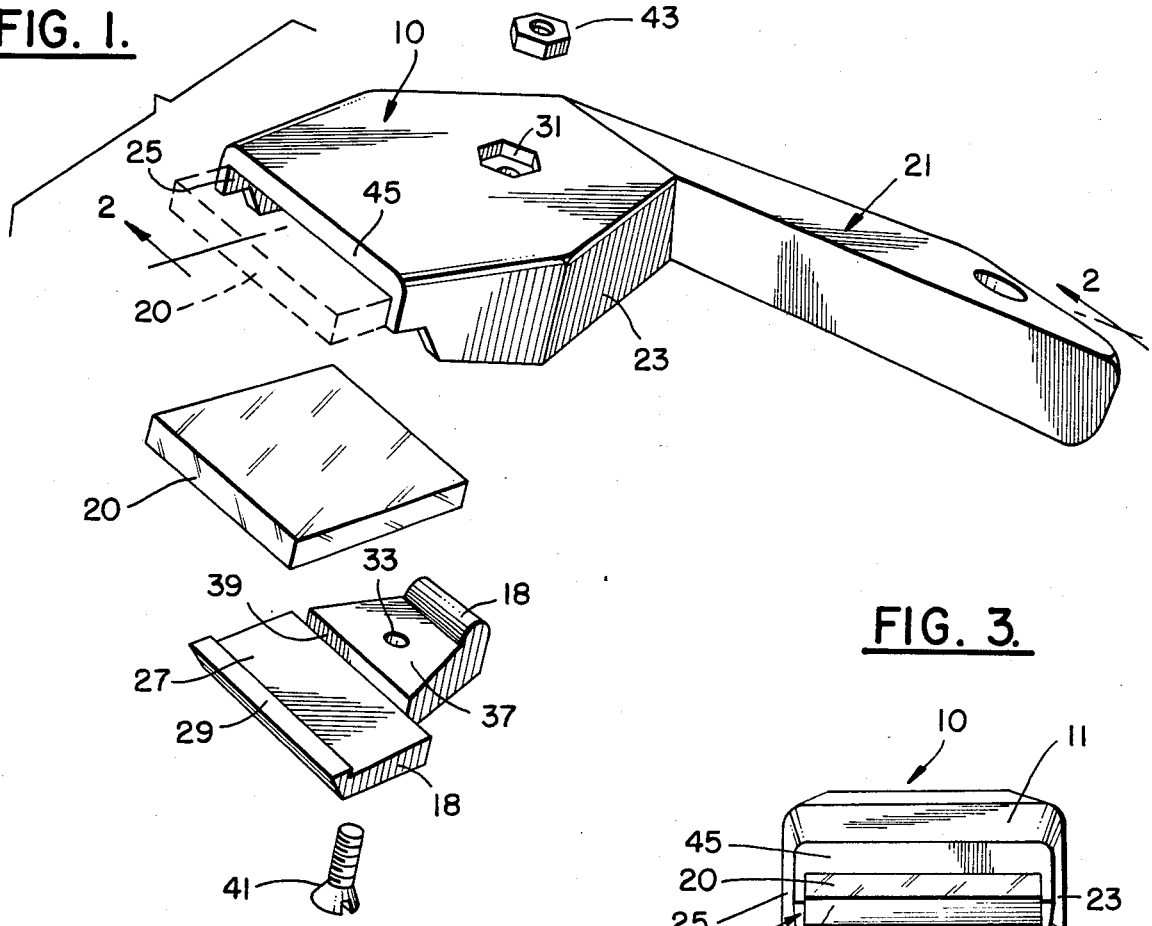
FIG. 1 is an exploded perspective view of the scraping implement comprising the subject of the present invention.
Figure 3:
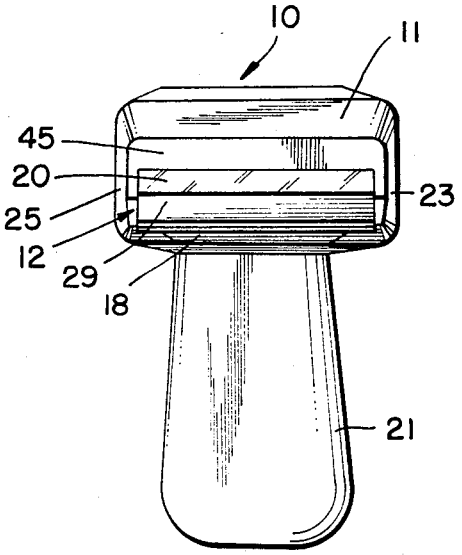
FIG. 3 is a front view in elevation of the scraping implement of FIG. 1.

Referring now to the drawings in detail, wherein like numerals indicate like elements throughout the several views, a scraping implement 30 constructed in accordance with the present invention includes a unitary, handle member provided with an essentially wedge-shaped housing portion 10 having an elongated grip portion 21 extending downwardly at an obtuse angle therefrom, which can be shaped from a suitable synthetic material such as foamed polypropylene.

The housing portion 10 includes a pair of opposed, sides 11 and 13 converging in a vertical edge 45. Sides 11 and 13 are connected to the contoured grip portion 21. The housing portion 10 also includes a recess 12 formed along side 13 having two stepped levels. The first level of recess 12 includes a surface 14 while the second level is relatively deeper, having a surface 16. A vertical wall 24 connects the two surfaces 14 and 16. The housing portion 10 has a substantially inverted, U-shaped cross-section providing downwardly extending side edges 23, 25.

A retaining member 18 includes an upright surface 19 adapted to be seated in a complementary shaped recess 26 in housing portion 10. Member 18 is preferably made from the same material as the handle member and has stepped recess surfaces 27, 37 connected by a vertical wall 39. Recess surface 27 terminates in a raised planar lip 29.

A renewable scraping element 20 is seated in the recess 12 against surface 16 between the surface 16 and lip 29 abutted against the vertical walls 24, 39 of recessed surfaces 16, 27 formed in the inner surface of the housing portion 10 and retaining member 18, respectively. A releasable securing means 22 comprising a threaded fastener 41 and nut 43 is disposed in countersunk openings 31, 33 in the housing 10 and retaining member 18, respectively, and is employed to draw the retaining member 18 and its complemental surfaces 17, 37 and 19 towards the surfaces 16, 14 and 26 of the handle member 10 to clamp the element 20 tightly in place in slightly canted relation relative to lip 29 against vertical surfaces 24, 39.

Figure 2:
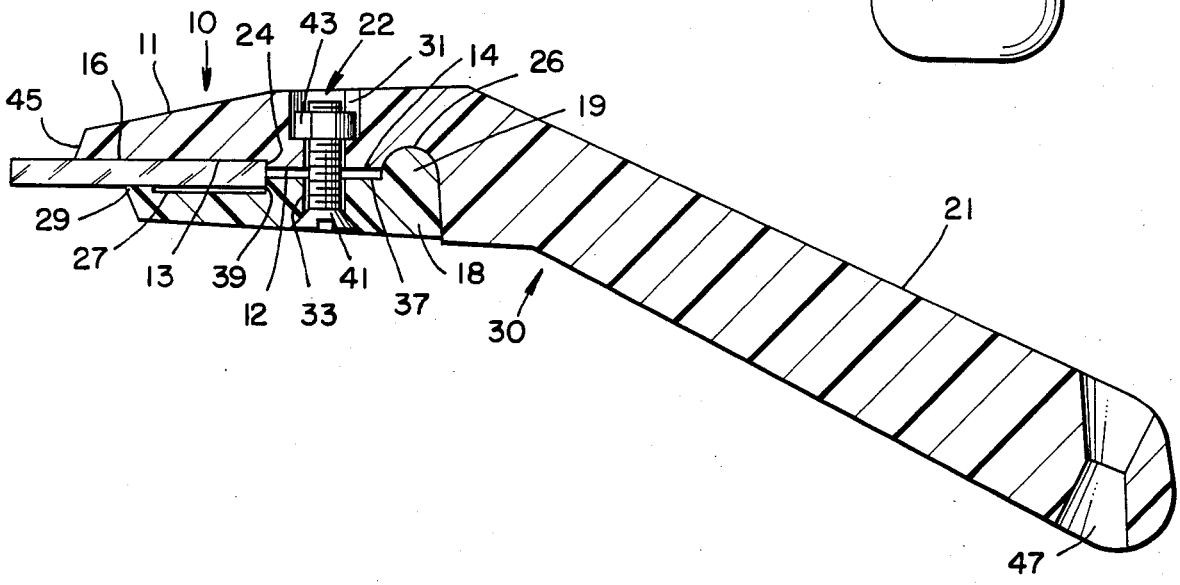
FIG. 2 is a longitudinal cross-sectional view of the scraping implement of FIG. 1, taken substantially along the plane indicated by line 2—2 of FIG. 1.
Figure 4:
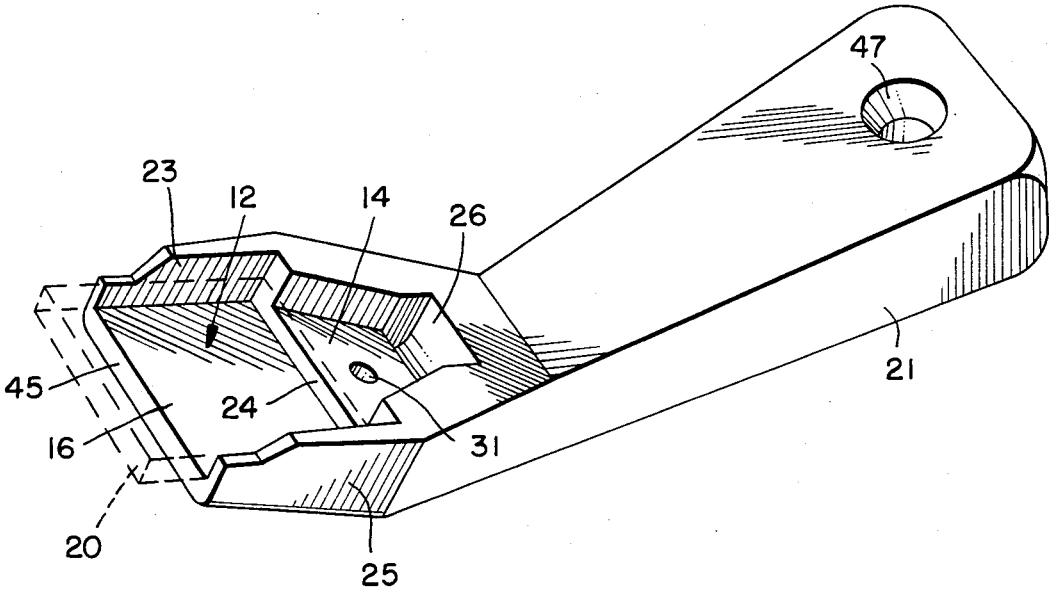
FIG. 4 is a perspective view of the handle body of the scraping implement of FIG. 1 turned upside down.

Referring also to FIGS. 1 and 2, it can be seen that the renewable scraping element 20 is preferably a square of a suitable material. In a preferred embodiment, the material would be plate glass which is relatively inexpensive notwithstanding its strength and ability to retain a sharp scraping edge. While other polygonal shapes could undoubtedly be used, a square plate is preferred since it can be repositioned within the recess 12 to provide four different scraping edges on each of its two opposed surfaces. Since scraping edges exist at both the top and bottom surfaces of a square element, such an element can be repositioned to provide a total of eight different scraping edges. In addition, the innermost edge of the square element can be firmly seated due to its cant against the inner vertical walls 24, 39 of the recesses 12, 27 to prevent the element from wobbling during use. The downwardly extending side edges 23, 25 of the handle 10 substantially cover the side edges of the scraping element 20 to preclude accidental engagement with the hand, and furnishes additional structural rigidity. The length of the scraping element is chosen so that it will extend approximately $\frac{1}{4}$ to $\frac{1}{2}$ inch from the edge 45 of housing 10.

An opening 47 in elongated grip 21 serves as a mounting opening for receipt of a pegboard hook or the like for storing and displaying the implement 50.

While there has been described what is considered to be a preferred embodiment of the invention, variations and modifications therein will occur to those skilled in the art once they become acquainted with the basic concepts of the invention. Therefore, it is intended that the appended claims shall be construed to include all such variations and modifications as fall within the true spirit and scope of the invention.

What is claimed is:

1. A hand held renewable scraping implement comprising:

a unitary, handle member having a pair of opposed sides forming a housing portion for receiving a scraping element at one end thereof and an elongated grip portion at the other end thereof, said grip portion and said housing portion being disposed at an obtuse angle relative to each other, said housing portion including a front edge, a first recessed area therein extending rearwardly from said front edge, and a cover surface along opposed side edges thereof extending downwardly relative to said front edge on opposed sides of said recessed area, said first recessed area including a first abutment wall opposing said one edge and extending essentially parallel to the latter, a retaining member having a portion adapted to be received within a complementary shaped recessed area in said housing portion and said retaining member having a second recessed area in overlying opposed relationship to said first recessed area in said housing, and said second recessed area including a second abutment wall opposing said one edge and extending essentially parallel to the latter, said housing portion of said handle member and said retaining member including aligned openings therein, a polygonal scraping element having a plurality of scraping edges, said scraping element being received within said overlying first and second recessed areas between said housing portion and said retaining member with one of said scraping edges thereof being disposed beyond said one edge of said housing portion between said downwardly extending cover surfaces and another of said scraping edges being in abutment with said first and second abutment walls along essentially the entire length of the latter; and releasable securing means extending through said aligned openings in said housing and said retaining member to urge the latter toward the former whereby to clamp said scraping element therebetween.

2. The scraping implement of claim 1 wherein said retaining member includes an upright lip extending along and across the front edge of said retaining member for seating and slightly canting said scraping element in said second recessed area against said first and second abutment walls.

3. The scraping element of claim 1 wherein said scraping element is formed from a sheet of glass.

4. The scraping element of claim 1 wherein said scraping element is substantially a square sheet.

5. The scraping element of claim 1 wherein said handle element and retaining member are formed from foamed polypropylene.

6. The scraping element of claim 1 wherein said gripping portion includes a mounting hole therethrough.

7. The scraping element of claim 1 wherein said housing and retaining member include countersunk openings therethrough receiving said securing means.

* * * * *